US006293199B1

(12) United States Patent
Gasparrini et al.

(10) Patent No.: US 6,293,199 B1
(45) Date of Patent: Sep. 25, 2001

(54) PRINTING PRESS CIRCULATION SYSTEM

(75) Inventors: Charles R. Gasparrini, Rye, NY (US); Christopher Hickey, Wolcott, CT (US)

(73) Assignee: Baldwin GraphicsSystems, Inc., Shelton, CT (US)

( * ) Notice: Subject to any disclaimer, the term of this patent is extended or adjusted under 35 U.S.C. 154(b) by 0 days.

(21) Appl. No.: 09/611,509

(22) Filed: Jul. 7, 2000

(51) Int. Cl.[7] ..... B41F 23/04
(52) U.S. Cl. ..... 101/487; 101/216; 101/349
(58) Field of Search ..... 101/487, 350.1, 101/216, 349

(56) References Cited

U.S. PATENT DOCUMENTS 4,300,450 11/1981 Gasparrini .
5,189,960 * 3/1993 Valentini et al. ..... 101/487
5,330,576 * 7/1994 Clauditz ..... 118/688
5,471,927 * 12/1995 Frank et al. ..... 101/216
5,611,278 * 3/1997 Garner et al. ..... 101/349
5,749,295 * 5/1998 Kurz ..... 101/350.1

* cited by examiner

*Primary Examiner*—Kimberly L. Asher
*Assistant Examiner*—M. Crenshaw
(74) *Attorney, Agent, or Firm*—MOrgan & Finnegan, LLP

(57) ABSTRACT

A printing press liquid circulation system including a cooling pan having a dedicated power return drain having a power drain orifice and optional cooling capacity located on and as part of the pan. The system induces or suctions flow of liquid from the pan, having a pan supply orifice, to a reservoir through a return conduit by connecting the return conduit to a power return drain. Proper design of the power drain orifice and the pan supply orifice allows for a matched pan supply and return system for an open hydraulic circuit, free of foam and flooding with no adjustments required.

11 Claims, 5 Drawing Sheets

PRINTING PRESS CIRCULATION SYSTEM

BACKGROUND OF THE INVENTION

1. Field of the Invention

The present invention relates generally to printing press circulation systems, and, more particularly, to a water pan having a dedicated power return drain and optional cooling capability located on and as part of the pan.

2. Description of Related Art

In a conventional printing press liquid circulating system, a cylindrical pan roller is partially immersed in a refrigerated or non-refrigerated liquid which is contained in a cooling pan. The pan roller is rotated to pick up the appropriate amount of cooled liquid from the pan and distribute a uniform film of liquid to the dampening system of the press.

FIG. 1 illustrates a conventional liquid circulating system. As illustrated in FIG. 1, a conventional liquid circulating system includes a circulator 110 housing a tank or reservoir (not shown) for storing the liquid and a compression refrigeration circuit (not shown) typically utilizing R12, R22 or R134A refrigerant (adopted for environmental reasons), and a pump 112.

The compression refrigeration circuit cools the liquid that is sent to either a single pan 120 or multiple pans on the printing press. The liquid fills the pan(s) 120 to a level determined by either a removeable standpipe or dam 124.

A supply conduit 114 extends between the circulator 110 and the pan 120 and provides for a relatively constant flow of liquid into pan 120. Liquid is forced through supply conduit 114 by the circulator pump 112 which is driven by an electrical motor or equivalent (not shown).

The standpipe 124 of the cooling pan drains the liquid to a liquid return conduit 116. Return conduit 116 directs the liquid back to the tank or reservoir in the circulator 110. The liquid continuously flows through the pans (while removing heat from the press) and enters the return conduit 116 by flowing over and into the standpipe drain 124. In some cases, the return flow is simply drained by gravity back to the circulator tank or reservoir. However, most pan drain hole sizes and the return line routing provisions (i.e. space, bends, and conduit paths) do not permit for simple gravity return.

The pump 112 pumps liquid through the supply conduit 114 to supply the pan with a cooling liquid and to circulate the liquid through the pan to the return conduit 116. The pump supplies liquid through the supply conduit 114 and a branch supplies the power drain to create a suction pressure (i.e. a pressure below atmospheric pressure) that is induced in the portion of the return conduit 116 between the pan 120 and the circulator 110.

Traditionally, the liquid has been cooled at the circulator 110 by the compression refrigeration circuit and then pumped to the pans 120. However, by the time the liquid reaches the pan 120, losses in cooling capacity have occurred during the transport phase through the supply lines 114. This reduction in cooling capacity reduces the ability of the liquid to remove the heat generated by the press operation.

Conventional circulators 110 have also been provided with a return line power drain 118 at the circulator 110 to create a vacuum in the return line 116 to assist return flow. For proper operation, the power drain 118 must provide a vacuum that allows for only liquid return from the standpipe 124 entry position. Too much vacuum, however, will cause foaming in the tank or reservoir as air will be drawn in, and too little vacuum will cause the pan to overflow.

With the power drain located at the circulator, the system uses cooled flow to operate the power drain. Approximately 40% to 80% of the pump output is used as motive flow for the power drain. However, as mentioned above, losses in cooling capacity occur during the transport phase through the supply lines.

A large number of press manufacturers produce a variety of presses, each having different size pan return holes, conduit lengths and shapes, space, required bends, and varying conduit return paths, creating a matrix of varying return flow conditions which cannot be handled properly with the present circulator power drains. Each pan system can have different return line lengths, bends and return line paths. Additionally, in a multiple pan system with a single power drain, ink debris in one return path will cause an imbalance and cause the return on one to flood while the rest foam.

Normally, one or more power drain sizes are used to cover this varying range by circulator manufacturers. However, these systems are hard to balance by flow control means to the power drain and are very troublesome when two or more pans are connected to only one power drain. Various attempts to control the power drain function, such as that disclosed in U.S. Pat. No. 4,300,450 to Gasparrini, have been made, but the basic problems still exist.

Another problem with power drains located at the circulator is that one return line is required for each pan to return the liquid back to the circulator tank or reservoir. These current circulating systems place limitations on the installation of conduits, resulting in unprofessional arrangements.

Thus, there exists a need for an improved printing press liquid circulating system that provides improved drain flow creating a balanced system, improved cooling capacity, ease of installation, and a more effective pan design.

SUMMARY OF THE INVENTION

The present invention satisfies such a need. A printing press circulation system according to one embodiment of the present invention comprises at least one pan for supplying liquid to a printing press. Each pan includes a liquid supply orifice and an outlet. A standpipe is disposed in communication with the outlet of the pan and configured to drain liquid from the pan while maintaining a substantially constant liquid level in the pan. The circulation system also includes a reservoir holding the liquid and a power drain corresponding to each pan. Each power drain includes a first inlet having a power drain orifice, a second inlet and an outlet. A drain conduit extends from the standpipe of the pan to the second inlet of the power drain for draining liquid from the pan. A return conduit extends from the outlet of the power drain to the reservoir. A pump is configured to pump liquid from the reservoir through a supply conduit to the pan liquid supply orifice and the first inlet of the power drain to draw liquid from the pan and by inducing suction in the return conduit.

In another embodiment of the present invention, a printing press circulation system comprising at least one pan for supplying liquid to a printing press, each pan including a liquid supply orifice and an outlet. A standpipe is disposed in communication with the outlet of the pan. The standpipe is configured to drain liquid from the pan while maintaining a substantially constant liquid level in the pan. A reservoir for holding the liquid is also provided. A power drain corresponds to each pan, each power drain including an inlet having a power drain orifice and an outlet. A cooling mechanism corresponding to each pan is provided. Each cooling mechanism is located in proximity to the corresponding pan. A drain conduit extends from the power drain orifice of the power drain for draining the cooling mechanism and the standpipe. A return conduit extends from the outlet of the power drain to the reservoir. A pump is configured to pump liquid from the reservoir through a supply conduit to the liquid supply orifice and the cooling mechanism to induce a suction pressure in the return conduit to draw liquid from the pan to the return conduit.

In yet another embodiment, a printing press circulation system comprising at least one pan for supplying liquid to a printing press, each pan including an inlet and an outlet. A standpipe is disposed in communication with the outlet of the pan. The standpipe is configured to drain liquid from the pan while maintaining a substantially constant liquid level in the pan. The circulation system also comprises a reservoir for holding the liquid and a cooling mechanism corresponding to and located in each pan. Each cooling mechanism includes an inlet having a cooling mechanism inlet orifice, at least one pan flow orifice to supply the pan with liquid, and an outlet. A power drain corresponds to each pan, each power drain includes a first inlet having a power drain orifice for receiving liquid from the outlet of said cooling mechanism, a second inlet for receiving liquid from the standpipe, and an outlet. A return conduit extends from the outlet of said power drain to the reservoir. A pump is configured to pump liquid from the reservoir through a supply conduit to the cooling mechanism inlet orifice to induce a suction pressure in the return conduit to draw liquid from the pan to the return conduit.

DETAILED DESCRIPTION OF THE PREFERRED EMBODIMENTS

Certain preferred embodiments of the present invention will now be described in detail with reference to the drawings.

Figure 2:
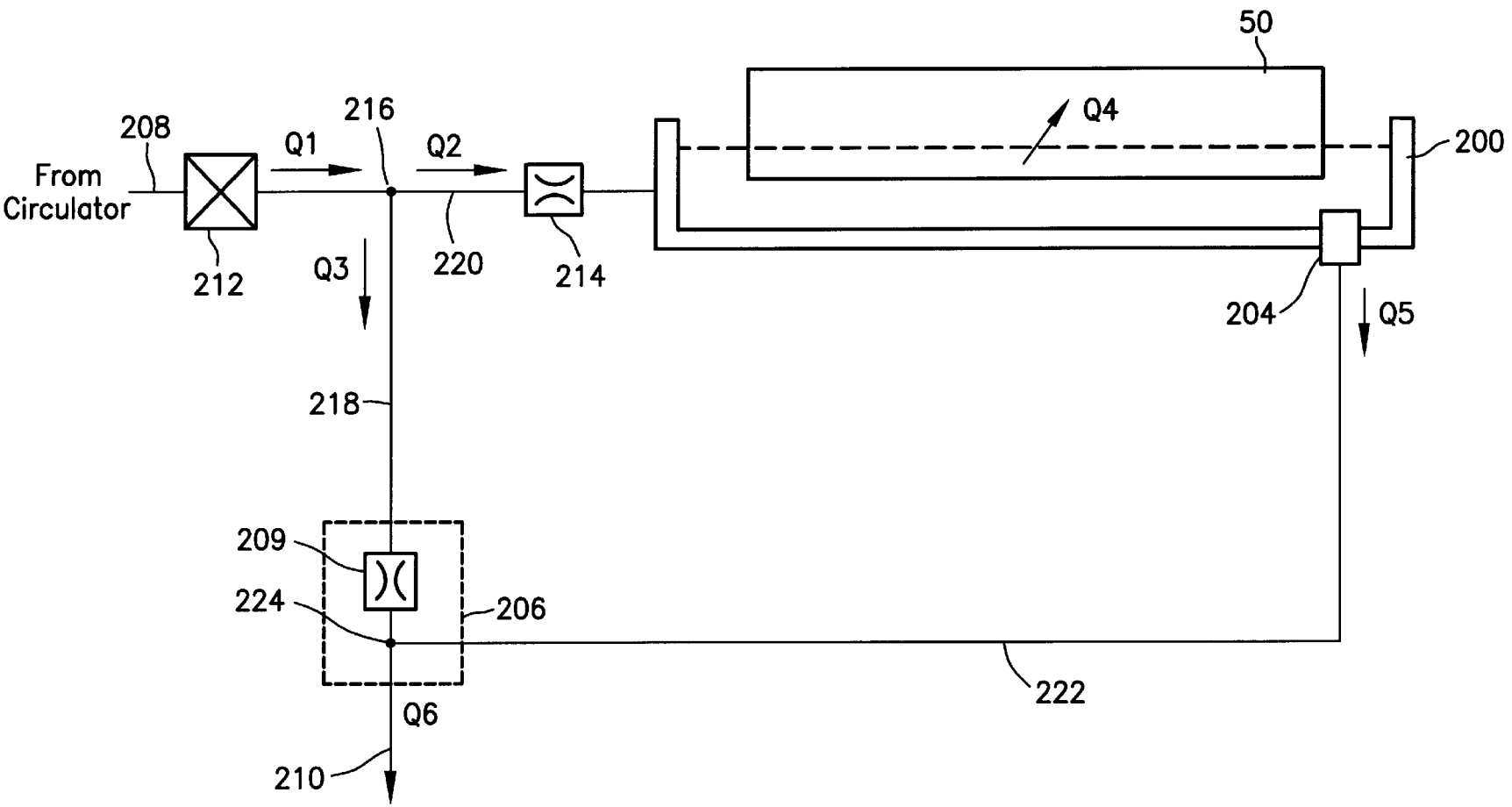
FIG. 2 is a schematic view of a circulating system including one embodiment of the cooling pan.

Turning first to FIG. 2, a circulating system according to one embodiment of the present invention is shown. The circulating system includes a circulator (not shown) having a tank or reservoir and a pump, a cooling pan 200, and a power drain 206 located in proximity to the cooling pan 200. In a circulating system having multiple cooling pans, each cooling pan has its own dedicated power drain.

As illustrated in FIG. 2, cooling pan 200 is adapted to partially immerse a roller 50 in liquid, such as, for example, refrigerated or non-refrigerated coolant, which is contained in the cooling pan 200. The liquid in the cooling pan 200 should be kept at a relatively constant temperature, and should flow in and out of the pan 200 at a relatively constant flow rate in order to prevent growth of algae and allow for circulation of the liquid to the circulator.

As illustrated in FIG. 2, the cooling pan 200 includes a pan liquid supply orifice 214 and an outlet in communication with a removeable standpipe (or dam) 204. The removeable standpipe 204 is located on a side opposite the liquid supply side of the pan 200, although, it is understood that the standpipe 204 can be located near the supply side. The standpipe 204 drains the liquid from the pan and maintains a substantially constant liquid level in the pan.

Figure 1:
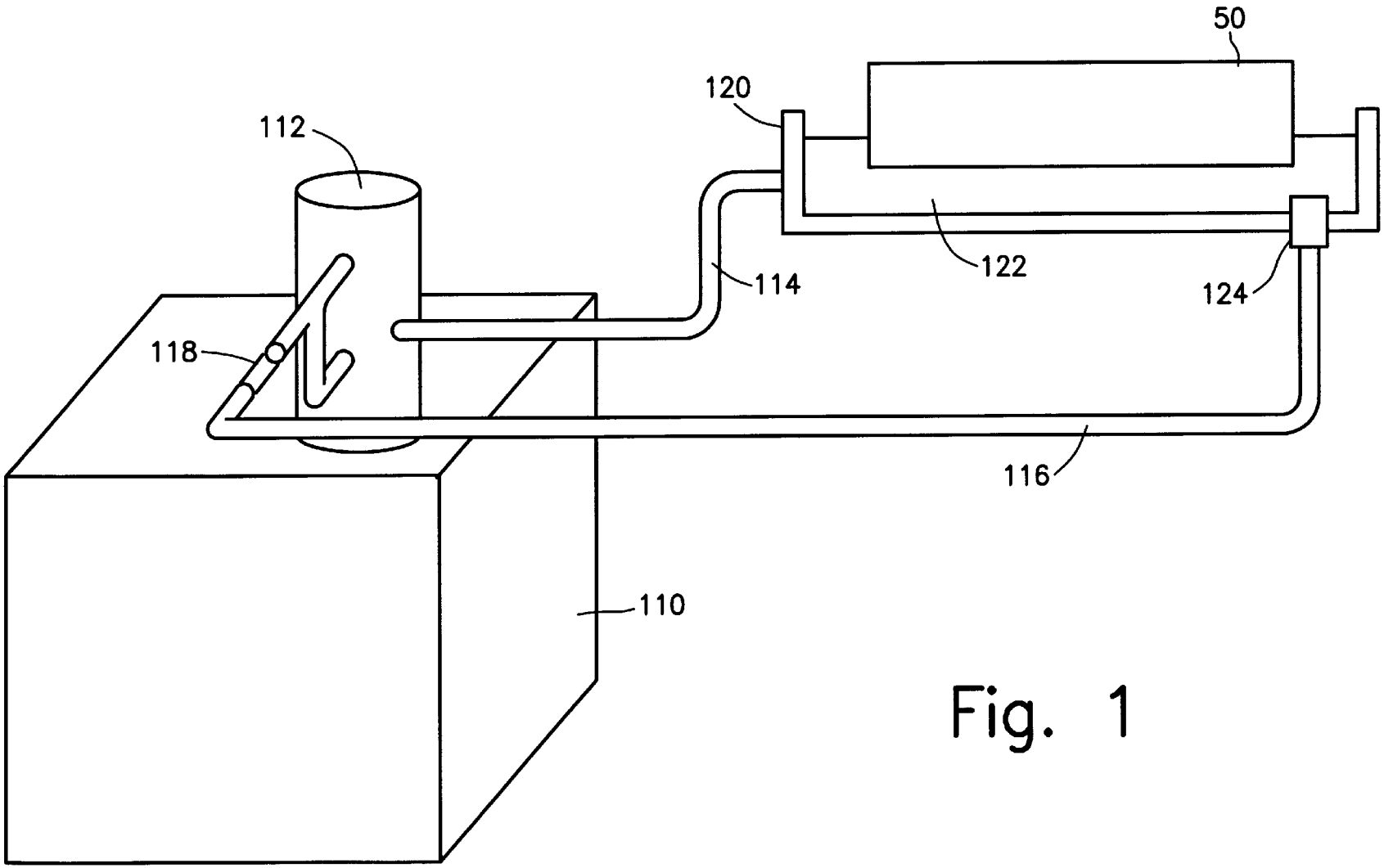
FIG. 1 illustrates a conventional printing press liquid circulating system.

Cooling pan 200 contains liquid which is supplied through supply conduit 208 extending between the circulator (not shown) and the pan 200 and providing a relatively constant flow of liquid into the pan 200. Liquid is forced from a tank or reservoir in the circulator through supply conduit 208 by a circulator pump which is driven by an electrical motor, or the like. The circulator used in this embodiment is similar to the circulator 110 illustrated in FIG. 1 and described above. However, as will be discussed in more detail later, the circulator can be modified to provide the liquid cooling mechanism on or about the cooling pan rather than utilize the compression refrigeration circuit at the circulator.

Figure 5:
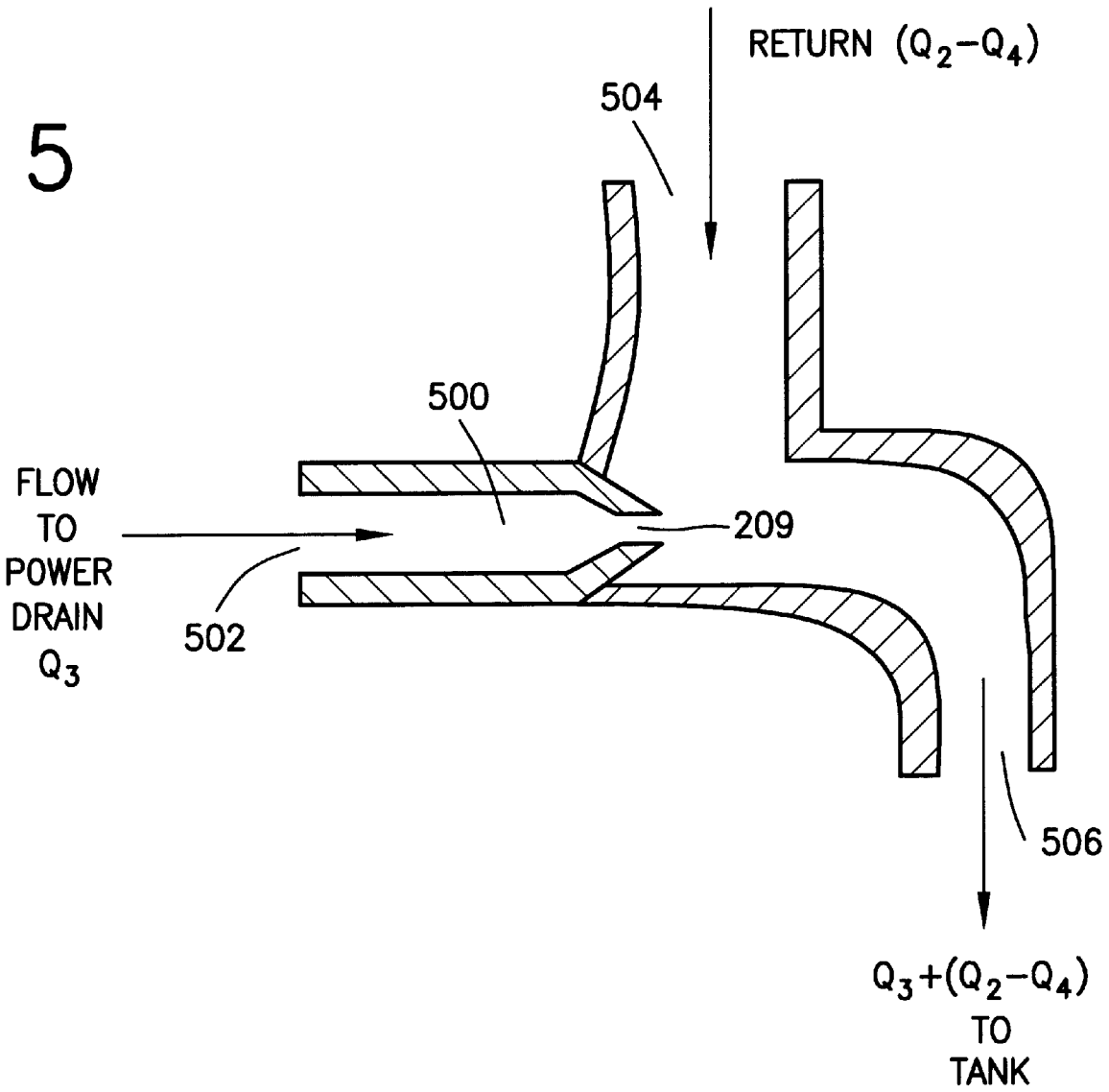
FIG. 5 is a schematic view of a circulation system including another embodiment of the power drain.

Each cooling pan 200 has associated therewith its own power drain 206. Each power drain 206 has a power drain orifice 209. The details of the power drain are shown in FIG. 5 and described in more detail below. One suitable power drain is available from Baldwin Graphic Products (Shelton, Conn.). The power drain 206 aids in maintaining a predetermined liquid level within the pan 200. Power drain 206 drains to a liquid return conduit 210 which returns the liquid to the tank or reservoir in the circulator.

Supply conduit 208 includes a total flow control valve 212 that adjusts the flow to both a pan liquid supply orifice 214 and the power drain orifice 209. Supply conduit 208 also includes a junction 216 therein, junction 216 being connected by an intermediate conduit 218 to the power drain 206, and by an intermediate conduit 220 to the pan liquid supply orifice 214.

The hydraulic flow of the liquid in the circulating system is increased as the pressure is increased at both inlets of both orifices 214, 209 by adjusting the total flow control valve 212. Essentially, more flow to the pan 200 is accompanied by more flow to the power drain 206, thus generating greater suction. Proper design of both orifices allows for a matched pan supply and return system for an open hydraulic circuit, free of foam and free of flooding with no adjustments required. Design practice can allow for these orifices to be either fixed or designed in such a way that orifice inserts can be used for a particular press pan design.

The removeable standpipe 204 is connected by drain conduit 222 to the power drain 206 at junction 224, leading to return conduit 210. Return conduit 210 directs the liquid back to the tank or reservoir in the circulator. The liquid continuously flows through the pans 200 (while removing heat and debris from the press) and enters the return conduit 210, via drain conduit 222, by flowing over and into the standpipe drain 204.

In operation, the circulator pump forces liquid from the tank or reservoir within the circulator through supply conduit 208 to the total flow control valve 212. The total flow of liquid, adjusted by the total flow control valve 212, causes a pressure to act on pan liquid supply orifice 214 and the power drain orifice 209. Flow arrows indicate the direction of flow in the various conduits shown in the drawings.

Flow Q1 from the circulator separates at junction 216 into flow Q2 and flow Q3. Flow Q2 flows into the pan 200 as governed by the pan liquid supply orifice 214. Flow Q3 flows towards the power drain orifice 209 by intermediate conduit 218 to create suction pressure. The flow Q5 exiting the pan 200 through the standpipe drain 204 will be reduced by the portion of liquid Q4 (Q2–Q5) picked up by the roller 50, thus reducing flow Q2. Therefore, since flow Q3 is used to create a suction pressure, it is important that the flow Q2 entering the pan 200 through pan liquid supply orifice 214 takes into account the amount consumed (Q4) by the press roller 50.

As shown in FIG. 5, power drain includes flow passageway 500 having an inlet 502 for the flow Q3 from intermediate conduit 218, the power drain orifice 209, an inlet 504 for flow Q5 (Q2–Q4) exiting the pan 200 through the standpipe drain 204, and an outlet 506 for flow Q6 (Q3+(Q2–Q4)) to return conduit 210 and, ultimately, to the tank or reservoir of the circulator. By pumping liquid through the passageway 500, a negative or suction pressure (a pressure below atmospheric pressure) is induced in the portion of the power drain between the inlet 504 and the outlet 506.

In the embodiment of FIG. 2, the liquid is cooled at the circulator and then transported to the pans 200 on the press. This cooled supply flow (Q3) is used for the particular purpose of powering the power drain directly. However, as discussed above, losses in cooling capacity occur during the transport phase through the supply conduit 208.

Figure 3:
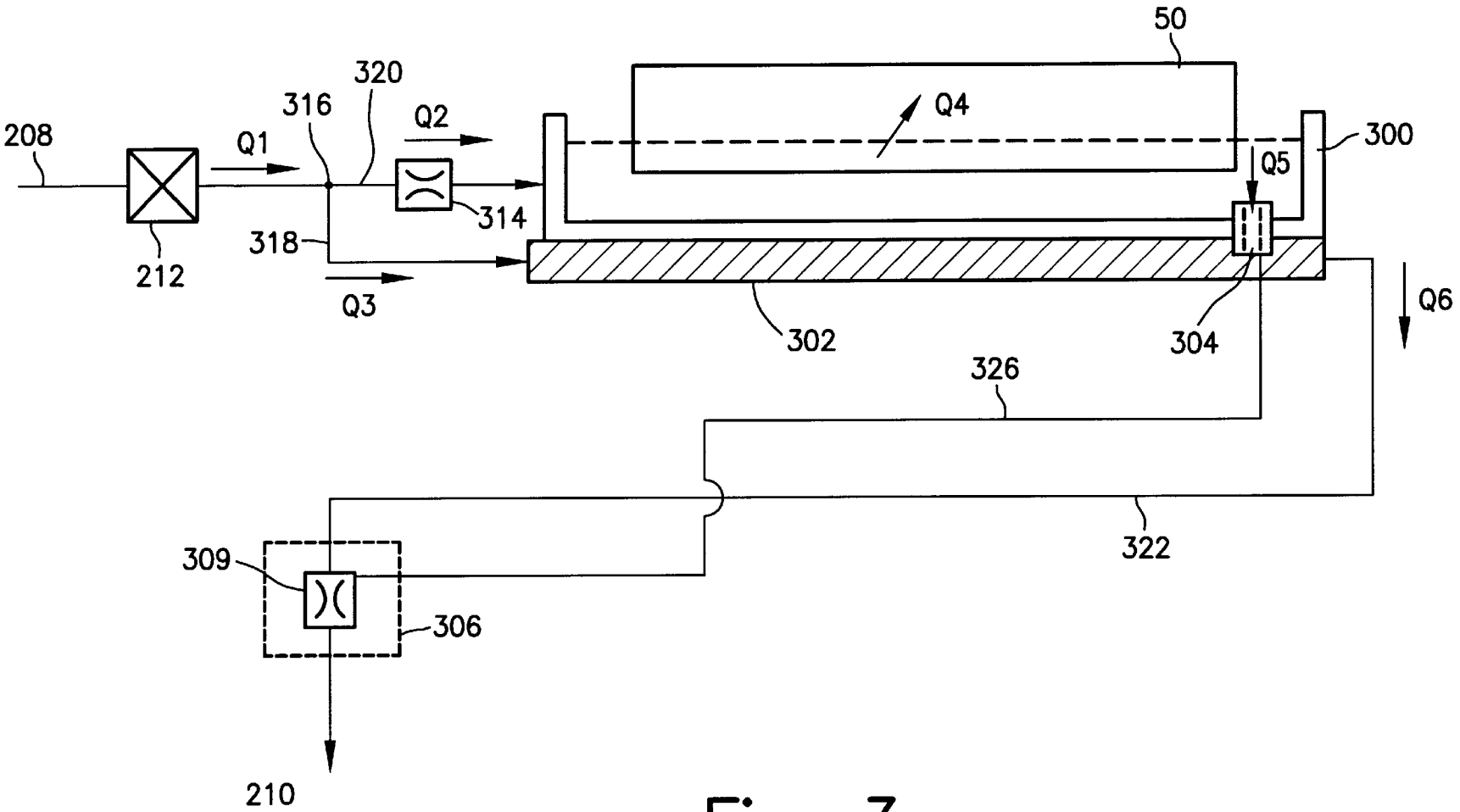
FIG. 3 is a schematic view of a circulating system including another embodiment of the cooling pan.

In an alternate embodiment as shown in FIG. 3, the liquid, particularly flow Q2, is cooled by cooling mechanism 302 located on or about the pan(s) 200. The cooling mechanism 302 may be mounted on, about, adjacent to, or integrated in the pan 300 in any number of ways known in the art, such as, for example, mounting bars or the like.

As shown in FIG. 3, supply conduit 208 includes a total flow control valve 212 that adjusts the flow to both a pan liquid supply orifice 314 and the power drain orifice 309. Supply conduit 208 also includes a junction 316 therein, junction 316 being connected by an intermediate conduit 318 to the cooling mechanism 302, and by an intermediate conduit 320 to the pan liquid supply orifice 314. Flow Q2 flows to the pan 300 as governed by the pan liquid supply orifice 314.

In this embodiment, the normal flow Q3 flows through the cooling mechanism 302 before returning to the circulator tank or reservoir through drain conduit 322 and return conduit 210. The flow exiting the pan 300 through the standpipe drain 304 will be reduced by the portion of liquid Q4 picked up by the roller 50, thus reducing flow Q2. The power drain inlet 504 receives the flow exiting the pan 300 through the standpipe drain 304 from an intermediate conduit 326.

Instead of using the cold supply flow Q3 to power the power drain directly, the flow Q3 in this embodiment goes through the cooling mechanism 302 (i.e. channels, coils, tubes or the like) on the pan 200. Since this flow is much higher than the pan flow Q2, it provides additional cooling capacity to the pan and much better liquid temperature control in the pan.

In this embodiment, a pressure acts on the inlet of the power drain after exiting the cooling mechanism as governed by the power drain orifice. Similar to the first embodiment, it is important that the flow Q2 entering the pan through pan liquid supply orifice takes into account the amount consumed (Q4) by the press roller.

In one embodiment, cooling mechanism 302 are electrical cooling devices, such as and with, for example, cooling coils or tubes, fins, or the like. One suitable cooling device is available from Melcor Thermoelectrics (Trenton, N.J.) under the trademark UltraTEC™. Although, any cooling mechanism used or known in the art can be used.

As mentioned above, proper design, through design practice, of both orifices 314, 309 allows for a matched pan supply and return system for an open hydraulic circuit, free of foam and free of flooding with no adjustments required.

Figure 4:
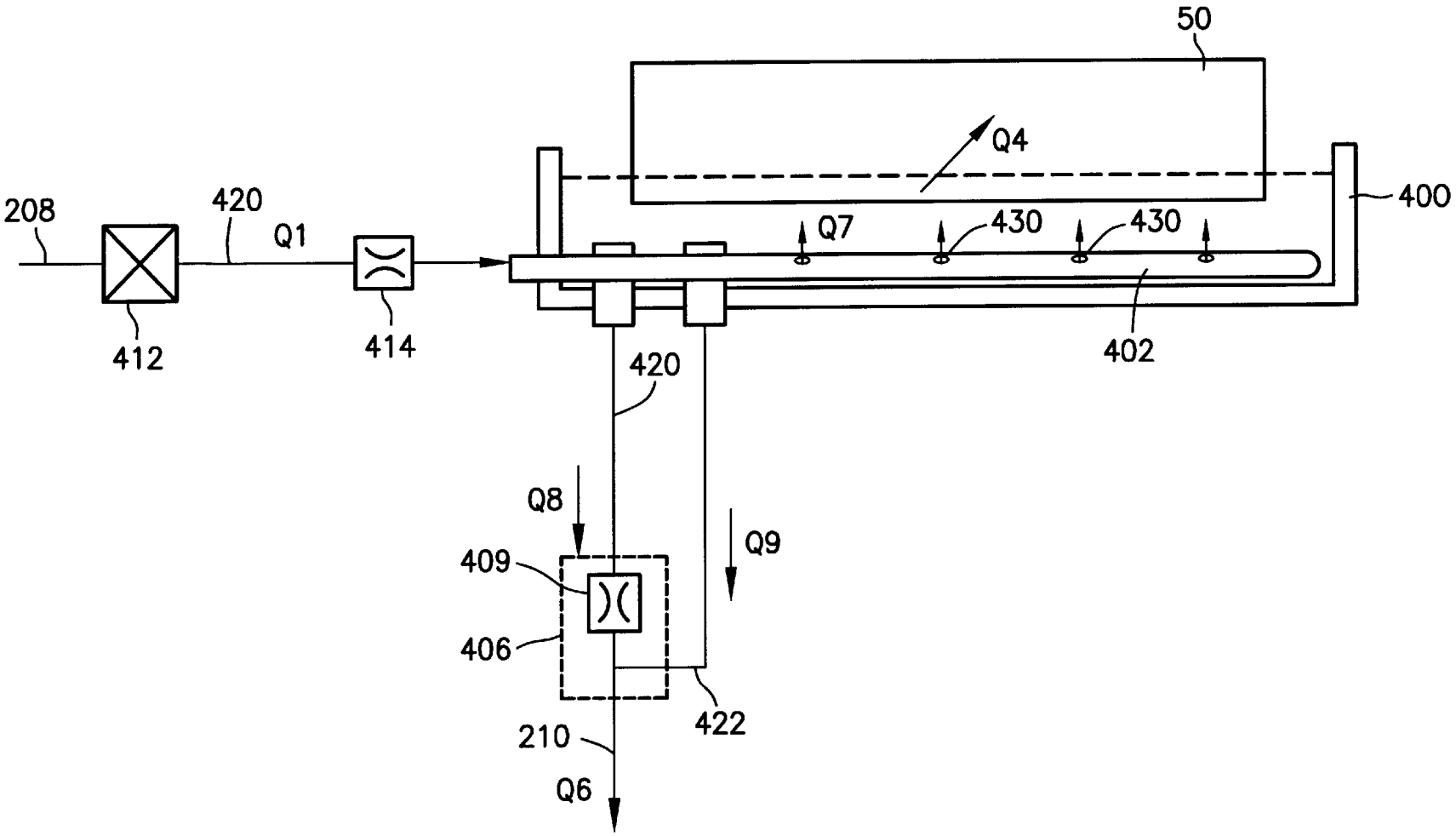
FIG. 4 is a schematic view of a circulating system including yet another embodiment of the cooling pan.

In yet another embodiment as illustrated in FIG. 4, the cooling mechanism 402 is located in the pan 400. In this embodiment, the total flow Q1, as adjusted by the total flow control valve 412 is supplied to the cooling mechanism 402 directly, causing a pressure to act on the cooling mechanism inlet. The cooling mechanism 402 includes a cooling mechanism inlet orifice 414 for receiving the flow Q1, and pan flow orifice or orifices 430 which are, in an embodiment in which the cooling mechanism is a coiling coil, spaced along the length of the coil as necessary for supplying the pan with cooled liquid flow Q7. In other words, flow Q7 flows from the cooling mechanism to the pan as governed by pan flow orifice(s) 430 located in the cooling mechanism 402. The exiting flow Q8 from the cooling mechanism 402 is used to power the power drain 406.

As discussed above, it is important that the flow Q7 entering the pan through cooling coil orifice(s) takes into account the amount consumed (Q4) by the press roller. The remaining flow Q9 (Q7–Q4) enters the standpipe drain 404, then intermediate conduit 422, and then to the suction port of the power drain 406.

From the power drain 406, the liquid (Q8+Q9) returns to the tank or reservoir in the circulator through return conduit 210. In an alternate embodiment in which more than one pan 220 is involved, the return conduit 220 connects to other return conduits from other pans used on other press units, not to a single power drain, so as to drain to the tank or reservoir with one return line. This avoid the installment problems as discussed above.

The cooling mechanism orifice 414 governing flow Q1 is designed along with the power drain orifice 409 governing the flow back to the circulator as a balanced system. Increasing the pressure at the inlet of the cooling mechanism will increase the pan flow Q1, as well as increase the power drain flow Q8 so that the system is always balanced, eliminating foaming and flooding.

This invention allows for the pan supply flow and power drain supply flow to be determined by proper orifice sizing in both, requiring no adjustments other than the total flow feeding both. When installed, the hydraulic circuit is an efficient press cooling system, resulting in a less costly pan design and ease of implementation.

It will be apparent to those skilled in the art that various modifications and variations can be made in the device of the present invention without departing from the spirit or scope of the invention. Thus, it is intended that the present invention embraces all such modifications and variations within spirit and scope of the appended claims.

What is claimed is:

1. A circulation system for a printing press having a cylinder, said circulation system comprising:

a pan for supplying liquid to the cylinder of the printing press, said pan including a liquid supply orifice and an outlet;

a standpipe configured to drain liquid from the pan while maintaining a substantially constant liquid level in the pan, wherein said standpipe communicates with the outlet of said pan;

a circulator reservoir holding the liquid;

a power drain dedicated to and located in proximity to said pan, said power drain including a first inlet having a power drain orifice, a second inlet and an outlet;

a drain conduit extending from said standpipe to the second inlet of said power drain for draining liquid from said pan;

a return conduit extending from the outlet of the power drain to said circulator reservoir; and a pump configured to pump liquid from said circulator reservoir through a supply conduit to the pan liquid supply orifice and the first inlet of said power drain to draw liquid from the pan and to induce suction in said return conduit.

2. The system of claim 1, wherein an intermediate conduit extends between the supply conduit and the first inlet of the power drain.

3. The system of claim 2, wherein the intermediate conduit includes a cooling mechanism located in proximity to the pan.

4. The system of claim 3, wherein the cooling mechanism is a cooling coil.

5. A circulation system for a printing press having a cylinder, said circulation system comprising:

a pan for supplying liquid to the cylinder of the printing press, said pan including a liquid supply orifice and an outlet;

a standpipe configured to drain liquid from the pan while maintaining a substantially constant liquid level in the pan, wherein said standpipe communicates with the outlet of said pan;

a reservoir for holding the liquid;

a power drain dedicated to and located in proximity to said pan, said power drain including an inlet having a power drain orifice, a second inlet and an outlet;

a cooling mechanism for cooling the liquid in said pan, said cooling mechanism located in proximity to said pan;

a drain conduit extending from the cooling mechanism to the power drain orifice of said power drain for draining liquid from the standpipe;

a return conduit extending from the outlet of said power drain to the reservoir; and a pump configured to pump liquid from the reservoir through a supply conduit to the liquid supply orifice and the cooling mechanism to induce a suction pressure in said return conduit to draw liquid from said pan and to the return conduit.

6. A circulation system for a printing press having a cylinder, said circulation system comprising:

a pan for supplying liquid to a printing press, said pan including an inlet and an outlet;

a standpipe configured to drain liquid from the pan while maintaining a substantially constant liquid level in the pan, said standpipe communicating with the outlet of the pan;

a reservoir for holding the liquid;

a cooling mechanism corresponding to and located in said pan, said cooling mechanism including an inlet having a cooling mechanism inlet orifice, at least one pan flow orifice to supply the pan with liquid, and an outlet;

a power drain dedicated to and located in proximity to said pan, said power drain including a first inlet having a power drain orifice for receiving liquid from the outlet of said cooling mechanism, a second inlet for receiving liquid from the standpipe, and an outlet;

a return conduit extending from the outlet of said power drain to the reservoir; and a pump configured to pump liquid from the reservoir through a supply conduit to the cooling mechanism inlet orifice to induce a suction pressure in said return conduit to draw liquid from the pan to the return conduit.

7. The circulation system of claim 1, further comprising a plurality of pans, each pan having a dedicated power drain.

8. The circulation system of claim 5, further comprising a plurality of pans, each pan having a dedicated power drain.

9. The circulation system of claim 8, wherein each of the pans has a cooling mechanism located in proximity to the corresponding pan.

10. The circulation system of claim 6, further comprising a plurality of pans, each pan having a dedicated power drain.

11. The circulation system of claim 10, wherein each of the pans has a cooling mechanism located in proximity to the pan.

* * * * *